United States Patent [19]

Paquin

[11] 4,096,006

[45] Jun. 20, 1978

[54] METHOD AND APPARATUS FOR MAKING TWISTED PAIR MULTI-CONDUCTOR RIBBON CABLE WITH INTERMITTENT STRAIGHT SECTIONS

[75] Inventor: Patrick Joseph Paquin, Hamden, Conn.

[73] Assignee: Spectra-Strip Corporation, Garden Grove, Calif.

[21] Appl. No.: 725,539

[22] Filed: Sep. 22, 1976

[51] Int. Cl.[2] ..... H01B 13/06

[52] U.S. Cl. ..... 156/55; 29/630 A

[58] Field of Search ..... 156/50–52, 156/56, 55; 174/117 F, 117 R, 117 FF; 29/630 C; 57/34 AT

[56] References Cited

U.S. PATENT DOCUMENTS

| | | | |
|---|---|---|---|
| 2,361,374 | 10/1944 | Abbot | 174/117 FF X |
| 2,564,874 | 8/1951 | Andren | 29/630 R |
| 3,239,396 | 3/1966 | Bohannon | 174/117 F UX |
| 3,468,120 | 9/1969 | Hildebrand | 57/34 AT UX |
| 3,579,823 | 5/1971 | Gressitt | 29/630 R |
| 3,724,190 | 4/1973 | Balbatun et al. | 57/34 AT X |
| 3,736,366 | 5/1973 | Wittenberg | 174/117 F X |
| 4,012,577 | 3/1977 | Lang et al. | 174/117 F X |
| 4,034,148 | 7/1977 | Lang | 174/117 F X |

*Primary Examiner*—David A. Simmons

*Attorney, Agent, or Firm*—I. Morley Drucker

[57] ABSTRACT

This invention relates to a method and apparatus for making multi-conductor cable. The multi-conductor cable comprises a plurality of insulated wire conductor pairs, each of said insulated conductor pairs having alternating twist and straight portions and comprises alignment means for precisely aligning both the twisted portions and straight portions of said insulated conductor pairs in a predetermined, laterally spaced, relationship with respect to each other.

The alignment means of the multi-conductor cable of this invention comprises a laminated plastic sheet, initially formed from first and second plastic sheets or films, the laminated film having (a) a plurality of precisely spaced encapsulating ducts formed therein, each encapsulating duct containing either an individual, insulated, straight portion of a conductor or an insulated conductor twisted pair and (b) nip areas extending laterally between, and joining, each of said precisely spaced encapsulating ducts.

The precisely spaced intermittent straight portions provide easy, mass termination sites and do not appreciably affect the electrical characteristics of the multi-conductor cable.

15 Claims, 25 Drawing Figures

FROM SUPPLY ROLLER
SUPPLY ROLL
TO TAKE UP SPOOL

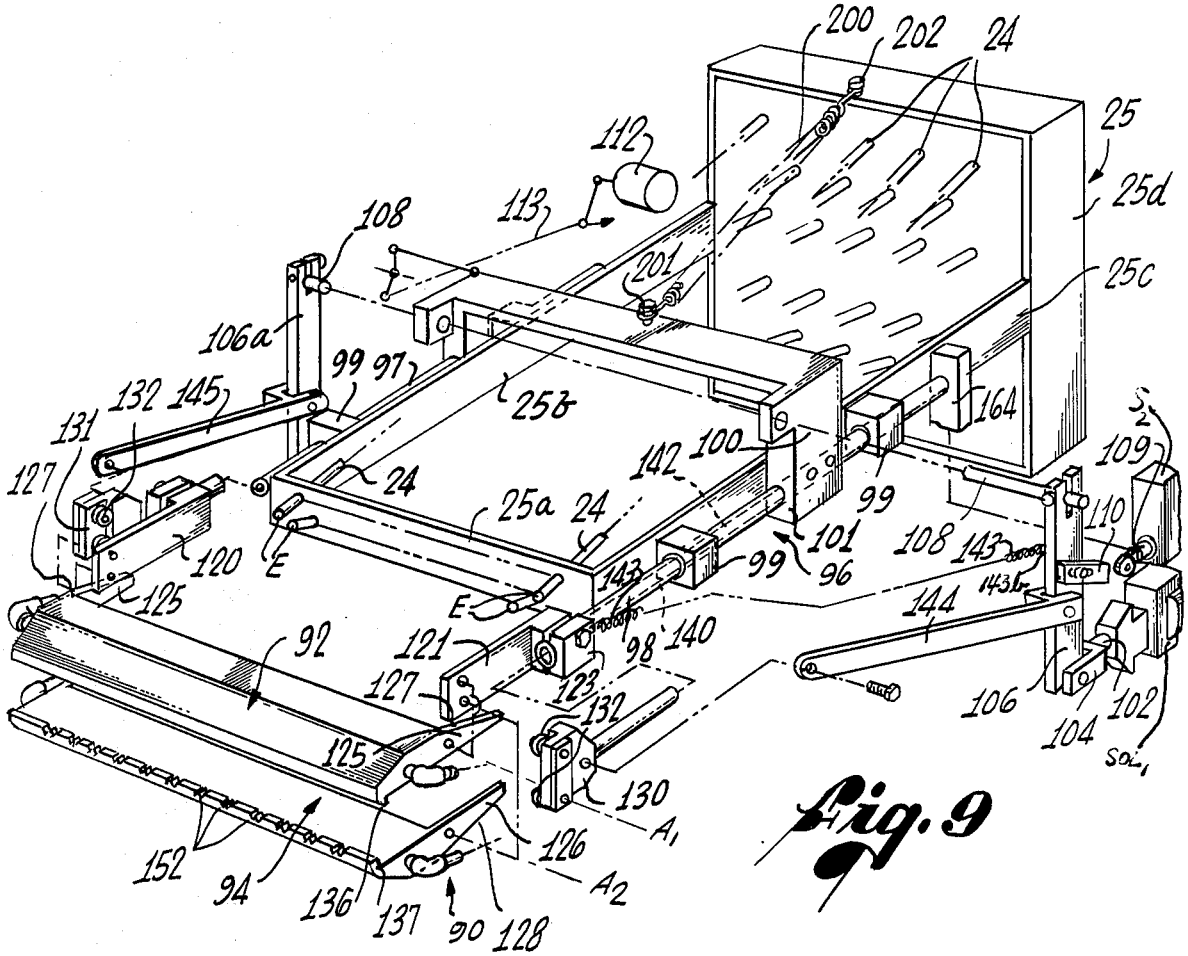
Fig. 9
Fig. 10
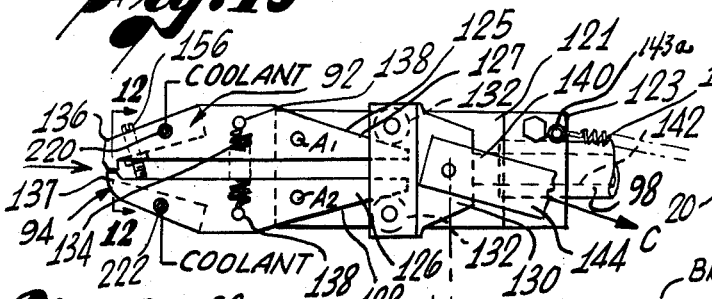
Fig. 11
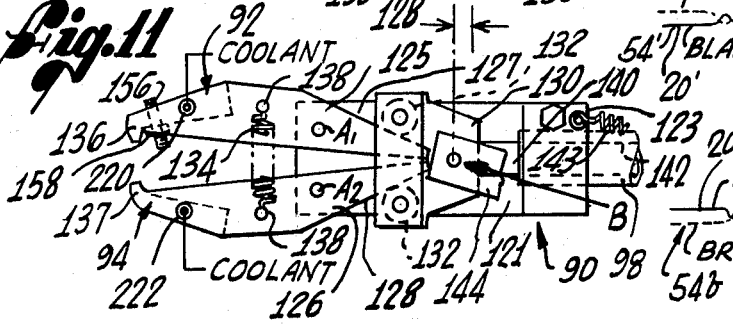
Fig. 12
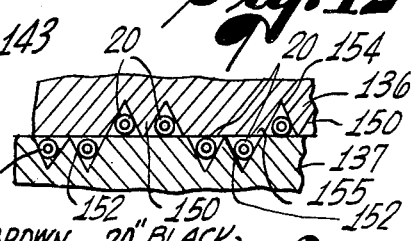
Fig. 21a
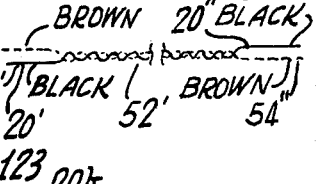
Fig. 21b
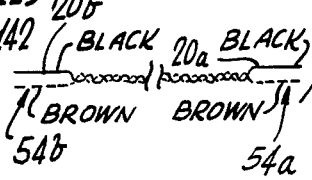

Fig. 13
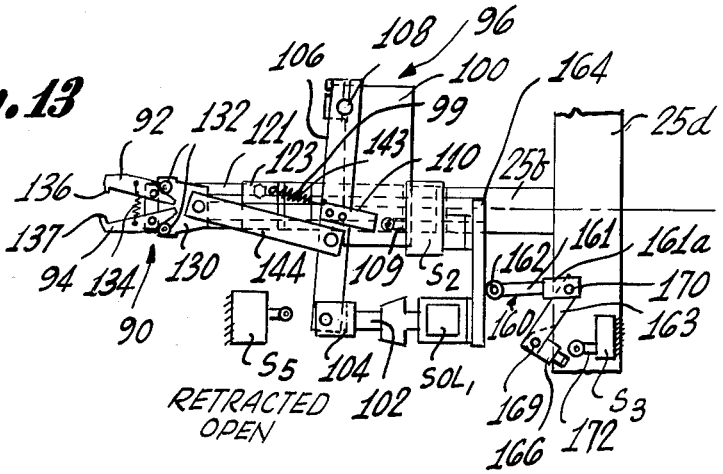
Fig. 14
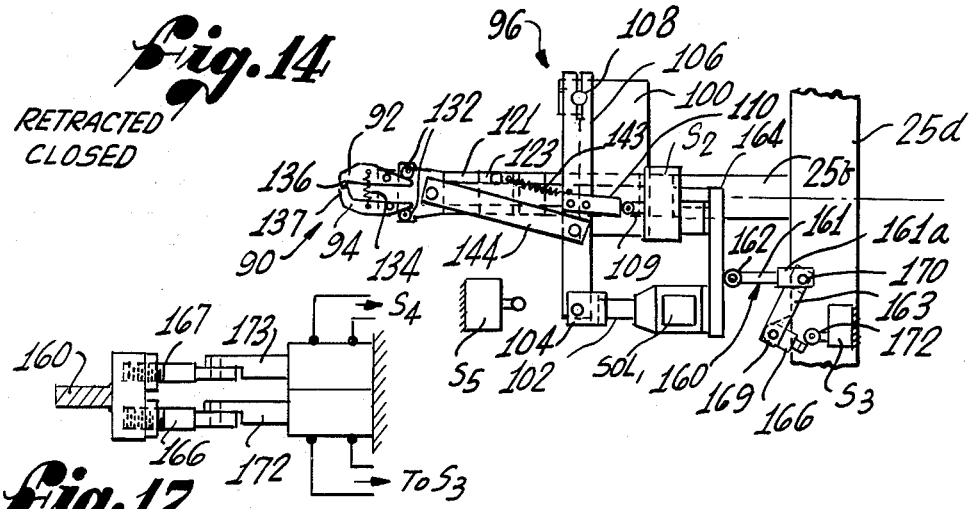
Fig. 17
Fig. 15
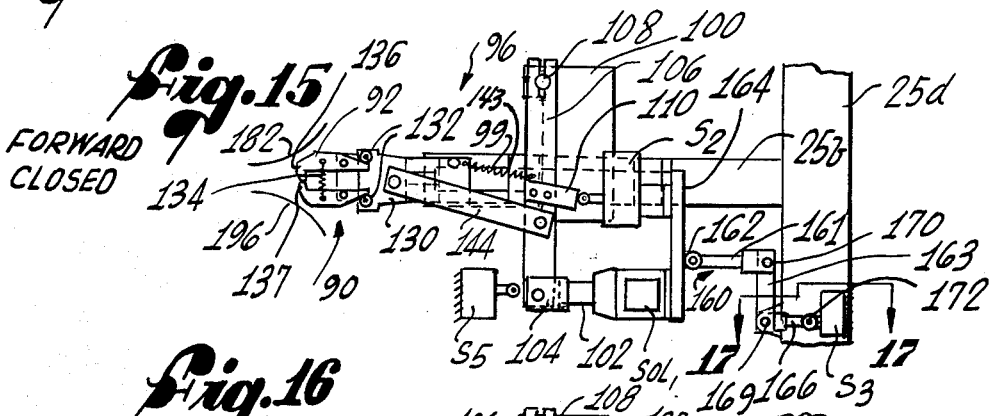
Fig. 16
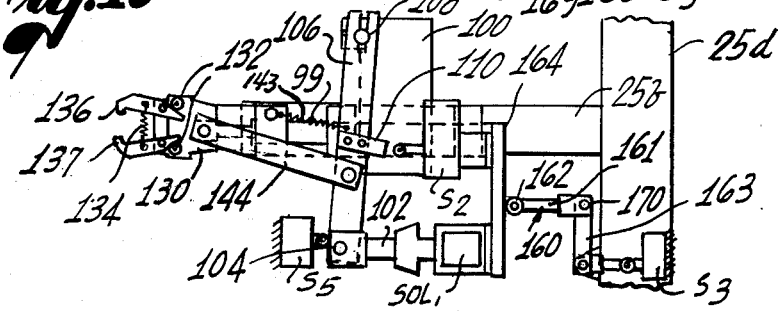

METHOD AND APPARATUS FOR MAKING TWISTED PAIR MULTI-CONDUCTOR RIBBON CABLE WITH INTERMITTENT STRAIGHT SECTIONS

CROSS-REFERENCE TO RELATED APPLICATIONS

This application is related to patent application Ser. No. 545,582 now U.S. Pat. No. 4,034,148 entitled "TWISTED PAIR MULTI-CONDUCTOR RIBBON CABLE WITH INTERMITTENT STRAIGHT SECTIONS", filed Jan. 30, 1975. Said Ser. No. 545,582 now U.S. Pat. No. 4,034,148 is directed, basically, to a multi-conductor twisted pair cable having intermittent straight sections while this application is directed primarly to improvements in a method and apparatus for making such cables. Ser. No. 545,582 now U.S. Pat. No. 4,034,148 is owned by the same assignee as is the instant application.

BACKGROUND OF THE INVENTION

It has become increasingly important to accurately space insulated multiple bands of conductors with respect to each other and laminated flat ribbon cable has increasngly come into use for this purpose. Precise control of electrical characteristics such as impedance, capacitance, cross talk and attentuation, especially important in digital data, and signal, transmission may be thereby achieved. Both controlled regular spacing and controlled irregular spacing, of multiple conductors in ribbon cable form has been achieved, in the prior art, by laminating the accurately spaced insulated (or uninsulated) multiple conductors between thin plastic film, such as 5 mil polyvinyl chloride (pvc) film or 5 mil Teflon* film.

* Teflon is a registered trademark of E. I. duPont de Nemours, Wilmington, Delaware.

Miltiple pairs of insulated conductors have also been accurately laterally spaced, in ribbon cable, by laminating multiple pairs of insulated twisted conductor pairs between thin plastic sheet or film, the twisted pairs being first laid onto a first plastic film and encapsulated and accurately oriented by a second plastic film laminated to the first film. The use of twisted pairs of multi-conductor cable is of great importance in the field of communications, data processing and other applications where cross-talk in signal transmission must be kept to a minimum. The laminated, twisted pair, multi-conductor ribbon cable of the prior art has, however, one material drawback, namely that present, standard, terminating techniques require that after the twisted pairs which are to be terminated have been separated from the laminate, the ends of each pair must then be untwisted manually, or with the aid of a special pliers or other tools. The separation procedure is time consuming and becomes impractical when dealing with large amounts of termination points or when it may be preferred to terminate the ends of such multi-conductor laminated ribbon cable onto an Insulation Displacement Connector (IDC) or other mass termination device; for an IDC or the like requires great accuracy in the spacing of the ends of the multi-conductor cable which are to be mass-terminated thereon.

The invention is therefore directed towards a method and apparatus for making improved laminated multi-conductor ribbon cable, having a plurality of twisted insulated conductor pairs in combination with intermittent straight sections laminated therein at precise lateral spacings which overcomes the just-mentioned time-consuming problem of untwisting the cable for termination purposes, while at the same time, more precisely orienting the termination points of the conductors for connection to IDC connectors, and the like.

The applicant is aware of U.S. Pat. No. 3,579,823 entitled "APPARATUS AND METHOD FOR APPLYING INDEXING STRIPS TO CABLE PAIR GROUPS" and issued to T. J. Gressit on May 25, 1971. This patent relates to a method and apparatus for the manufacture of multi-pairs of twisted cable. The twisted multi-pairs have compliant plastic strips placed at periodic straightened intervals in the twisted pairs for the purpose of maintaining the lateral spacing, at the straight intervals, between the conductor pairs.

It is a major object of this invention, however, to more positively achieve a precise, lateral spacing of both twisted pair portions and the intermittent straight conductor portions of the multi-conductor cable pairs, so that mass termination of the straight portions can be reliably achieved, as well as realizing other processing advantages. The method and apparatus, by which this may be accomplished, is set forth herein.

SUMMARY OF THE INVENTION

This invention is directed to a method and apparatus for making a laminated, multi-conductor ribbon cable having a first laminating plastic film on which is placed a plurality of pairs of insulated conductors, each of said pairs of insulated conductors having alternating twisted portions and straight portions, and a second laminating plastic film which encapsulates and orients the plurality of insulated conductor portions along a precise predetermined, lateral spacing.

The first and second plastic films are preferably heat welded or heat sealed under pressure, to each other, in the nip areas on either side of the conductors and the films may also be heat welded to the insulation of the conductor portions themselves in order to further anchor the individual conductors or conductor pairs, with respect to adjacent individual conductors or conductor pairs.

Mass termination of the cable occurs by simply transversely slitting the cable within a straight cable portion, and mass terminating the conductor ends onto an IDC, or other connector, having mass termination contacts spaced equally to that of the spacing between the straight portions of adjacent conductors.

More specifically, the method of this invention involves the following steps:

(a) twisting a plurality of individual insulated moving conductors into a series of twisted pairs having a predetermined length and pitch. The formation of the twisted pairs is preferably performed during the initial travel of the individual insulated conductors from appropriately placed spools, such twist formation being termed herein as "in-line twisting'-'—as opposed to the individual conductors being twisted at some earlier time, and then placed in the processing line in twisted pair form;

(b) terminating the in-line twisting of the moving conductor pairs but not the forward travel of the conductors;

(c) immediately after the termination of in-line twisting positively mantaining each of the moving, insulated conductors along straight, precisely laterally spaced, paths for a predetermined distance to thereby form the intermittent straight portions of the multi-conductor cable;

(d) alternately laminating the twisted portions of the conductors and the straight portions of the conductors, between plastic sheets, while positively maintaining precise lateral spacing of both the twisted portions and straight portions during lamination;

(e) in a second cycle, commencing in-line twisting of moving conductors into twisted pairs after formation of the straight portions of the multi-conductor cable has been completed; and (f) cooling the laminated cable so formed.

The apparatus for performing the foregoing process involves the following:

(a) means for precisely starting and stopping the in-line twisting of insulated conductor pairs including twist apparatus indexed to stop in a precisely predetermined conductor orientation;

(b) means for maintaining a series of straight conductor portions immediately after cessation of each twist phase of the process including a comb moving with, and between, the conductors, to maintain the precise lateral spacing between conductors just prior to lamination;

(c) means for precisely aligning the twisted pairs during the lamination including a first laminating roller having a series of channels or grooves therein for containment and precise spacing of each twisted conductor pair during lamination of the twisted portions of the cable; and (d) means for maintaining precise alignment of the straight portions of the cable during lamination including a second laminating roller having a series of channels or grooves therein for containment and precise spacing of the straight portions during the lamination thereof, the first and second laminating rollers being sequentially positioned for the lamination of the alternating twist and straight portions, respectively.

The resulting multi-conductor ribbon cable of this invention may be briefly described as one which comprises:

a plurality of insulated wire conductor pairs, each of said insulated conductor pairs having alternating twisted portions and straight portions; and alignment means for aligning said insulated conductor pairs in a predetermined spaced relationship with respect to each other, the alignment means comprising a laminated plastic film having a plurality of spaced encapsulating ducts formed therein, each encapsulating duct containing either an individual straight conductor portion or an insulated conductor twisted pair portion and having nip areas extending laterally between, and joining, each of said spaced encapsulating ducts.

BRIEF DESCRIPTION OF THE DRAWINGS

FIG. **6*a* is a cross-sectional view taken along the line 6*a*—6*a* of FIG. 6 when twist conductor portions are being laminated.

Figures 6, 6A, 6B, 7, 8, 8A:
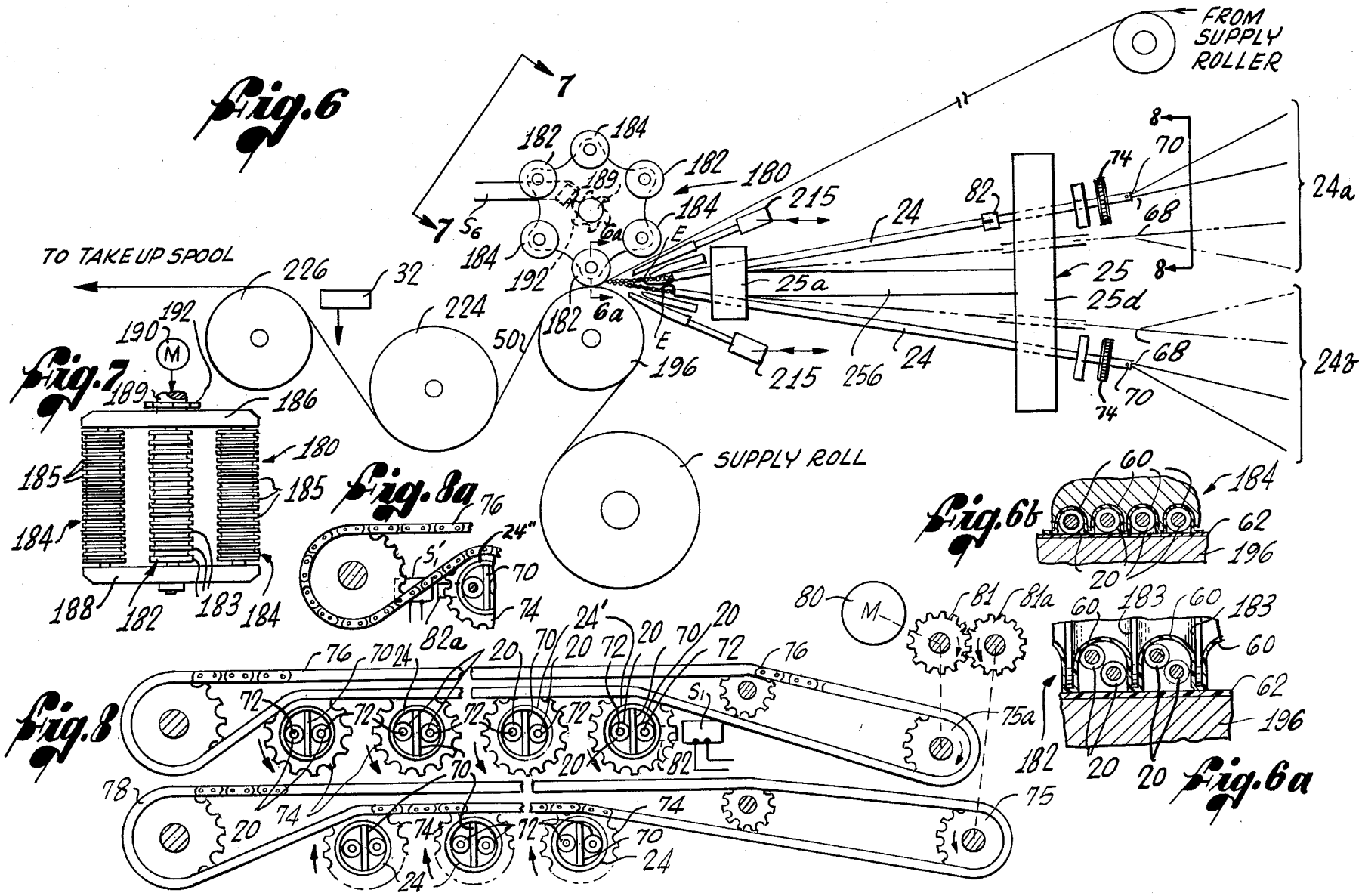
FIG. 6 is a partially diagrammatic side elevational view of the processing line for making the multi-conductor cable.
FIG. 6*b* is a cross-sectional view, taken along the same line 6*a*—6*a*** but at a later time when straight conductor portions are being laminated.
FIG. 7 is a plan view of a laminating turret roller employed during the lamination of the cable and is taken along the line 7—7 of FIG. 6.
FIG. 8 is an end elevational view of a portion of the twist control apparatus, as viewed along the direction of the line 8—8 of FIG. 6.

FIG. **8*a* is a fragmentary, end elevational view of the left-hand portion of a modified form of the twist control apparatus shown in FIG. 8**;

FIG. 9 is an exploded view, in perspective, of a movable carriage and comb apparatus for positively aligning portions of the moving cable into straight portions, after the twist portions of the cable have been formed, and thereafter maintaining the said straight cable portions for a predetermined cable length;

FIG. 10 is a side elevational view of the comb apparatus in conductor clamping position, looking in the direction of arrow "X" of FIG. 9;

FIG. 11 is a side elevational view of the comb apparatus in open, non-clamping position, looking in the direction of arrow "X" in FIG. 9;

FIG. 12 is a partial, enlarged, cross elevational view of the clamping jaws of the comb, taken along the line 12—12 of FIG. 10, showing the relationship of the straight portions of the insulated conductors to the comb teeth;

FIGS. 13–16 are partial, side elevational, views of the carriage and comb apparatus of FIG. 9, as viewed in the direction of arrow "X" of FIG. 9, and shown in various sequenced positions, of carriage travel and comb orientation, namely:

FIG. 13 — retracted carriage position, open comb position;

FIG. 14 — retracted carriage position, closed comb position;

FIG. 15 — forward carriage position - closed comb position; and

Figure 18:
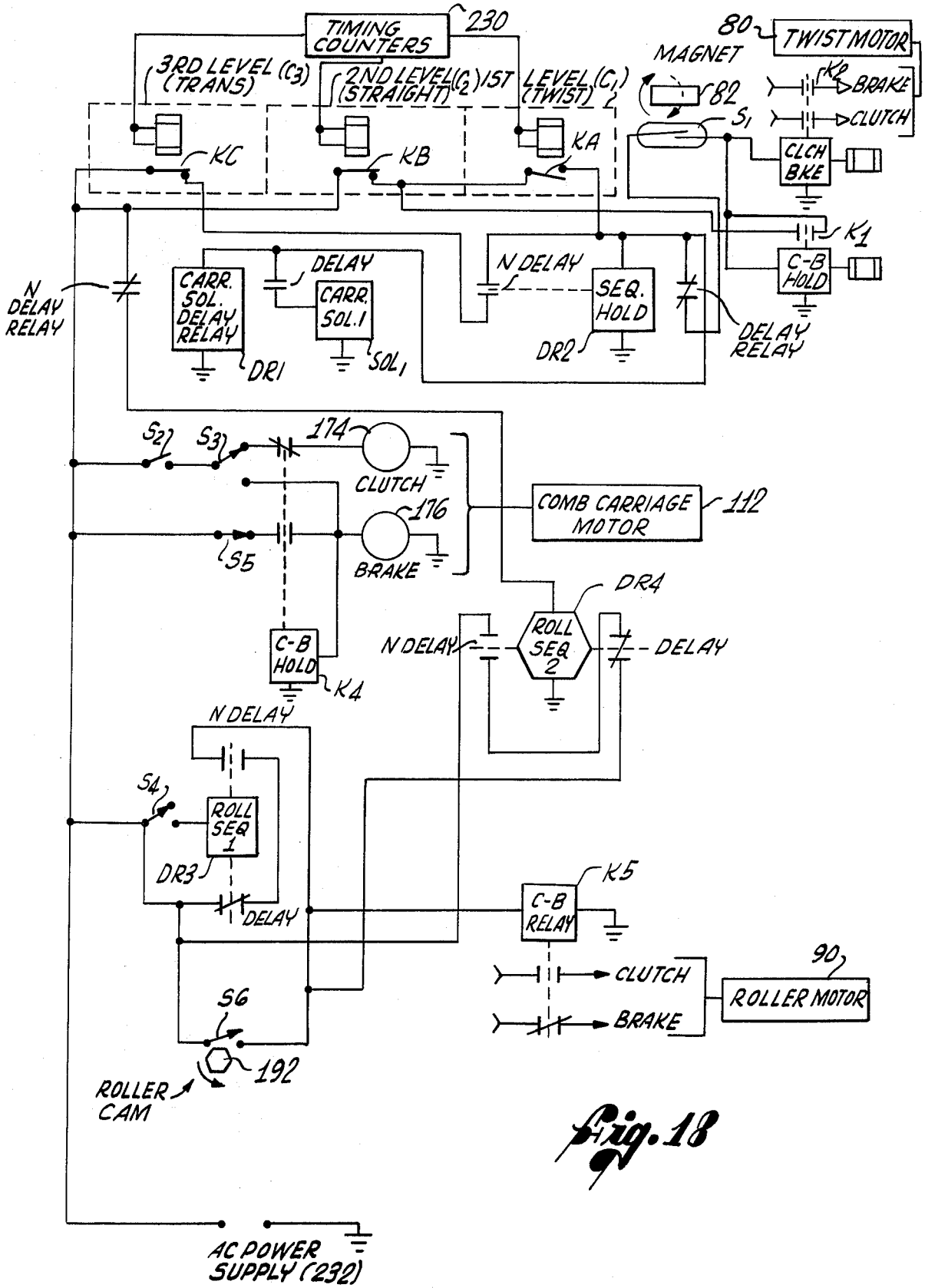
Figure 20:
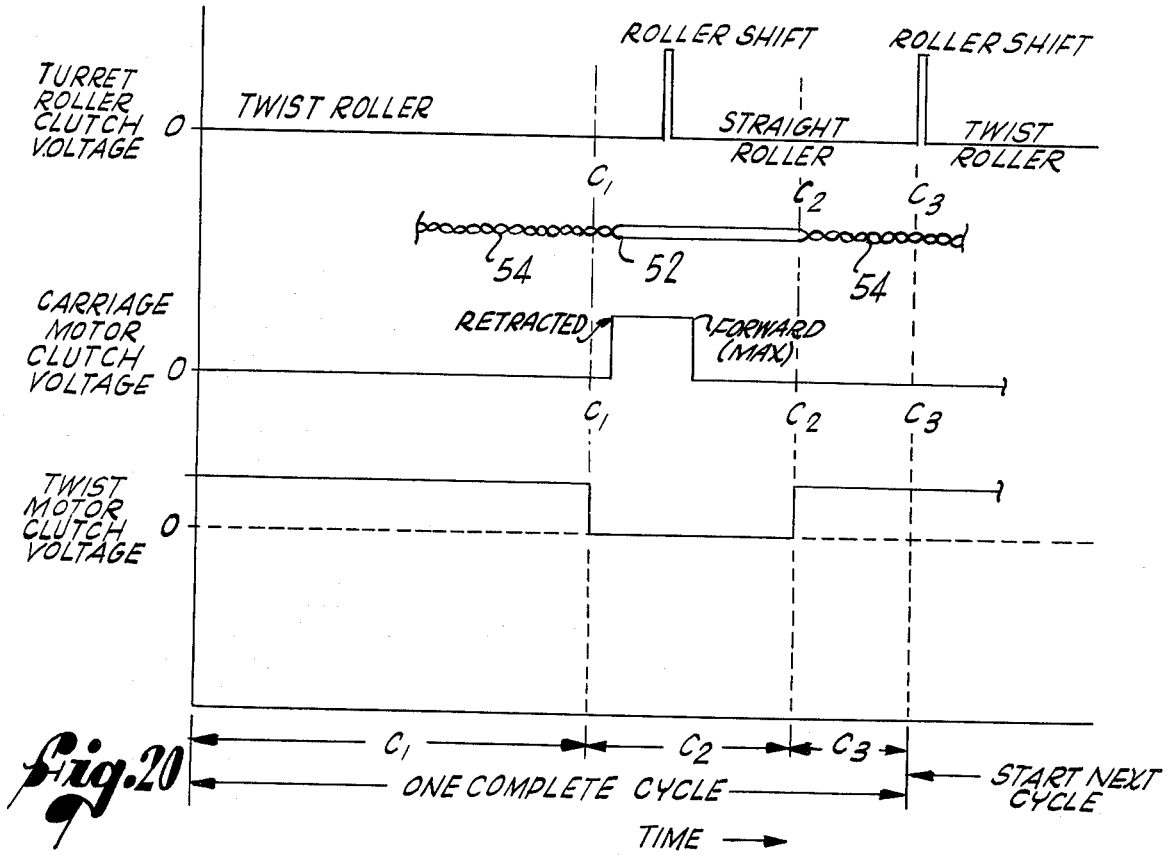
Figure 19:
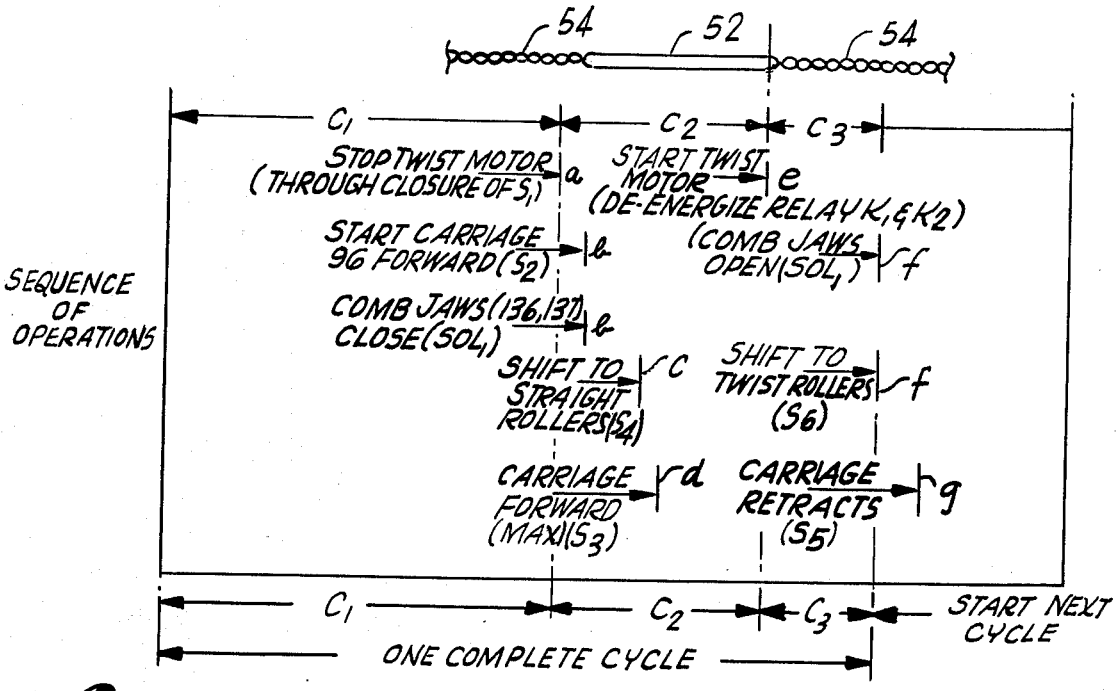

FIG. 16 — forward carriage position - open comb position;

FIG. 17 is a top plan view, taken along the line 17—17 of FIG. 15, showing a pair of switching arrangements to disengage and brake carriage movement and commence turret roller movement;

FIG. 18 is a schematic diagram of the electrical interconnections between the major components of the apparatus of this invention;

FIG. 19 is a schematic drawing designating the programmed sequence of one complete cycle of the process and apparatus referenced to the alternating twist and straight portions of the multi-conductor cable;

FIG. 20 shows, in graph form, the relationship of the voltages sent to the clutches of the twist motor, comb carriage motor and turret roller motor measured against time; and FIGS. 21*a* and 21*b* show, schematically, plan views of different forms of twist and straight cable made by the process and apparatus of this invention.

DETAILED DESCRIPTION OF THE INVENTION

A. Introduction

Figure 1:
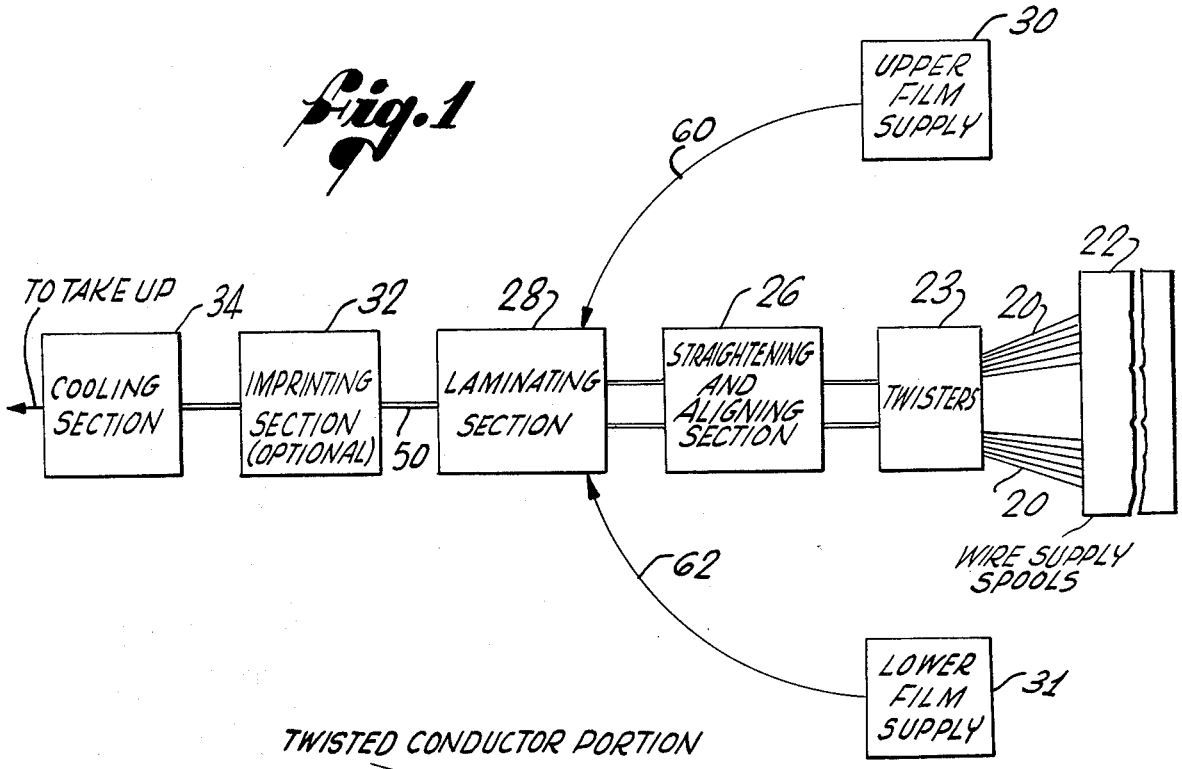
FIG. 1 is a block diagram indicating the main process and apparatus stations employed in this invention.
Figure 2:
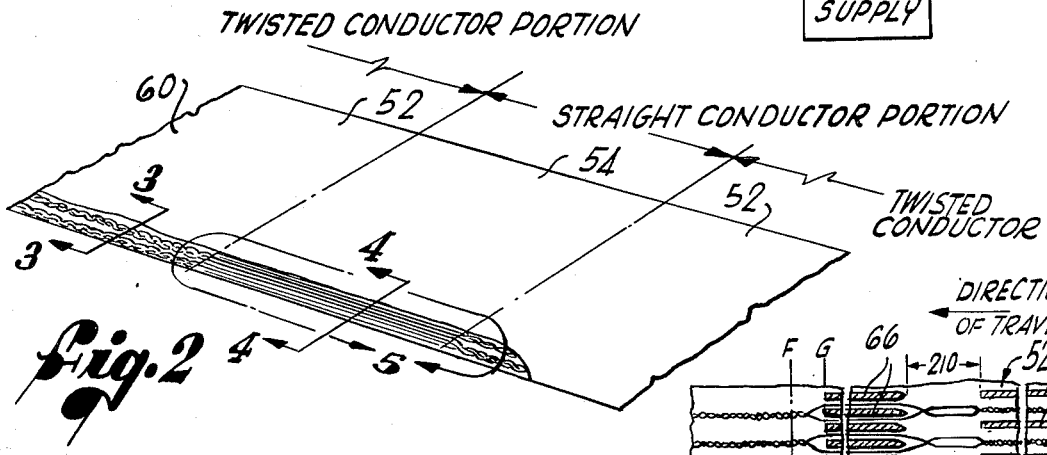
FIG. 2 is a perspective view of a multi-conductor cable formed by the method and apparatus of this invention, in which a portion of the cable is shown with the upper plastic laminating sheet partially removed to reveal the alternating twist and straight portions of the aligned insulating conductors.

Referring now to FIG. 1, an overview of the various process and apparatus stations will first e set forth. Individual insulated conductors, designated by the number 20, are unwound from a series of spools 22 (shown diagrammatically only), passed through a plurality of twister tubes in a twister zone 23, thence through a straightening and aligning zone or station 26, and into a laminating zone or station 28. Plastic laminating sheets 60, 62 are also fed into the laminating section 28 (from upper and lower spools 30, 31 respectively) to encapsulate both the twisted portions of the cable and the alternating straight portions, which are then laminated under heat and pressure, to produce thereby a hot laminated multi-conductor cable having laterally aligned alternating twisted and straight sections.

The thus formed cable 500 may then be passed through an imprinting section (for affixation of codings, trademarks, or other markings) if desired, and thence to a cooling section 34, for cooling, beore being wound onto take-up spools (not shown) in a conventional manner. A constant-speed motor, of conventional design, (not shown) is employed to pull the cable through the various stations, just outlined, under a constant and predetermined tension.

The thus formed cable 50 is shown particularly in FIGS. 2–5. The alternating twist portions and straight portions of the cable 50 are designated generally by the numerals 52, 54, respectively.

Figure 3:
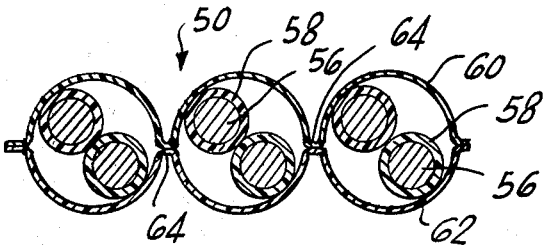
FIG. 3 is a partial cross-sectional view of the cable taken along the line 3—3 of FIG. 2.
Figure 4:
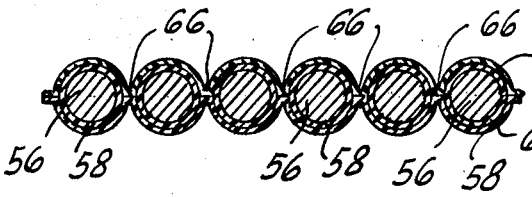
FIG. 4 is a partial cross-sectional view of the cable taken along the line 4—4 of FIG. 2.

Referring particularly to FIGS. 3 and 4, each of the individual insulated conductors 20 employed in this invention, preferably comprise a central metal conductor 56, e.g., of copper or aluminum with a preferably round polyvinyl chloride (pvc) or other plastic insulation 58 formed therearound. The wire gauge and insulation thickness may be varied within wide limits which are well known in the art.

The first (upper) and second (lower) laminating plastic sheets or film of the cable 50 designated by the numerals 60, 62, respectively, may be made of pvc or Teflon. or other pliable, heat sealable plastic film. The thickness of the film may vary within wide limits, e.g., of the order of 4–12 mils, although other thicknesses may also be employed depending upon the application of the finished cable 50.

Figure 5:
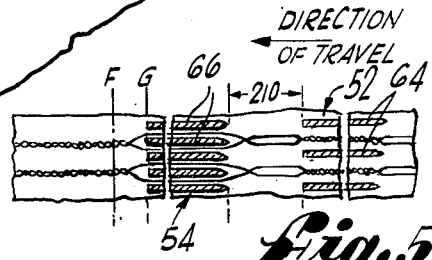
FIG. 5 is an enlarged plan view of the portion of the multi-conductor cable shown by the arcuate arrow designated 5—5 of FIG. 2.

The upper and lower laminated films 60, 62 constitute the alignment means for both the twisted pair portions 52 and straight portions 54 of the cable 50. This alignment is formed, during processing, by forming encapsulating ducts or channels which contain individual straight conductor portions alternating with twisted pair portions, each of these porrtions being precisely laterally spaced by means of heat-welded nip areas extending laterally between and joining each of the said encapsulating ducts. The welded nip areas in the twisted portion of the cable 20 are disignated by the numeral 64, and in the straight portion of the cable by the numeral 66, as best shown in FIGS. 3–5.

The various apparatus and process zones will now be described in detail.

B. Twister Zone

Referring now to FIGS. 1, 6 and 9, especially, a plurality of pairs of individual, insulated conductors 20 are fed from spools 22 into and through a plurality of elongated twister tubes 24. Each of the twister tubes 24 are rotationally mounted, within a rigidly mounted twister frame 25. The twister frame 25 comprises an upstanding rear twister block **25*d*, a front twister block 25*a* and side brace members 25*b*, 25*c*. The rear portions of the twister tubes 24 are mounted within rear twister block 25*d*. The twister tubes 24 extend through and are mounted within front twister block 25*a***.

The twister tubes 24 are preferably segregated into an upper group of tubes and a lower group of tubes, termed herein as upper tube bank **24*a* and lower tube bank 24*b*. The conductor entrances 68 to the twister tubes 24 are spaced somewhat from each other, to permit the drive mechanism (to be described) for the twister tubes 24 to be mounted thereto. The spacing is best seen in FIGS. 6 and 8**.

Each twister tube 24 is substantially circular, in cross-section, is provided with a separating pin 70 at the entrance 68 thereto, and is provided also with a pair of interior conductor tubes 72, running substantially the entire length of each twister tube. The tubes 72 are stably mounted within each twister tube 24, by a welding operation, or the like.

As the conductor pairs approach the entrance to the twister tubes 24, they are usually twisted, in random fashion, to some extent, but as each of the conductors 20 of each pair approaches the interior tubes 72, each such conductor 20 is passed around opposite sides of the separating pin 70 and is thus separated from the other conductor 20 in the pair, so that only a single conductor 20 passes into each one of the interior tubes 72.

The individual conductor 20 of each pair is maintained separate and distinct from the other conductor 20 forming the pair as they pass through the interior tubes 72. Twisting of the conductors 20 of each pair, commences, therefore, immediately at the point of exit of the conductors 20 from the twister tubes 24, designated by the letter E in FIGS. 6 and 9.

The upper and lower banks **24*a*, 24*b*, of twister tubes 24 converge toward each other, to the closest extent possible, at the exit side thereof (just forward of frame member 25*a*), so that the upper and lower banks of emerging conductor twisted pairs will achieve a minimal angular relationship at exit E. The upper and lower banks 24*a*, 24*b* of twister tubes 24 are themselves each in substantial horizontal alignment at the point of exit E from the twister tubes, as can be best seen in FIG. 9. The conductor pairs emerge from exit E of tubes 24** in two, closely adjacent parallel rows.

The twister tubes 24, in each of the upper and lower banks **24*a*, 24*b*, not only converge toward each other, as viewed in side elevation, but may converge inwardly somewhat as viewed in top plan view, as best seen in FIG. 9**.

The exact spatial arrangement of twister tubes 24 and their quantity, depends upon the cable width, conductor spacing, and number of conductors desired. For example, if a 16 pair –32 conductor cable is to be made, two rows of four twister tubes each may be mounted in the upper bank **24*a*, and two rows of four twister tubes may be mounted to form the lower tube bank 24*b*, as shown in FIG. 8**.

Each of the twister tubes 24 have a sprocket 74 mounted, at the rear thereof, which sprockets 74 are drivable, in unison, by chain means 76, 78, the chain means being, in turn, drivingly engaged by the sprockets 74, 75*a* through gears 81, 81*a*, by means of twist motor 80.

The exact pitch, or number of twists to the inch of each conductor pair, may be adjusted by adjusting the rate of conductor travel and/or the rate of rotation of the twister tubes 24. Also, the twister tubes 24 in the lower bank can be rotated in the same or different direction as the upper bank, depending upon the direction of the twist of each conductor pair desired in the final cable 50.

Referring to FIG. 8, the upper and lower bank of twister tubes 24 are shown as being drivingly engaged for opposite rotations. In this way, when a twisted conductor pair from an upper bank 24*a* of twister tubes 24 is laid into the conductor formation immediately next to a twisted pair from the lower bank 24*b* of twister tubes 24, immediately adjacent twisted conductor pairs will then assume twists in opposite, or reverse, directions with respect to each other. The reverse twist directions, of immediately adjacent twisted pairs in the finished cable 50, is of advantage in many aspects of electrical signal transmission.

As the twister tubes 24 commence rotation, upon energization of twist motor 80, the moving conductors 20 of each pair commence twisting, at substantially exactly the same time, i.e., at the exit E of each of the twister tubes. The length of the twisted portion of the cable is determined by a counter mechanism $C_1$, shown schematically in FIG. 18. The counter mechanism is conventional in design and senses the length of the twist pairs made.

At the completion of the twist phase of the process, i.e., at the end of the first counter level, $C_1$, the clutch of the twist motor 80 is disengaged and positively stopped, by a conventional brake means shown schematically in FIG. 18.

The exact position of the stop of the twist motor is important for this reason. It is preferably desired that the line, drawn through the axis of any two conductors 20 in a pair, after the twist phase, lie in a substantially horizontal planar configuration, as they emerge from exits E of the twister tubes 24. This becomes important insofar as it is desired to have an essentially flat, or planar relationship, of conductors 20 in the straight portions 54 of the cable 50 for connection to a conventional IDC connector. To this end, one or more reed switches $S_1$, are energized at the end of the first level counter $C_1$, and attracts a rotating magnet 82, mounted to a rotating twister tube 24' to exactly index or position all twister tubes 24 so that the lines drawn between the axes of each conductor, in a pair, are substantially horizontal and planar as they exit from the twister tubes 24. This relationship of adjacent conductors in the upper bank, and in the lower bank is best shown in FIG. 12. The closure of reed switch $S_1$ then closes secondary electrical circuits to disengage a conventional clutch means (not shown) of the twist motor 80 and apply the brake means (not shown) of the twist motor.

The next step in the process after the twist phase just described requires that the conductor pairs now emerging from the twister tubes 24 in a substantially horizontal planar, non-twisted relationship, as previously described, be precisely aligned both in the horizontal and vertical directions, to form an essentially precisely laterally spaced flat conductor assembly just prior to the lamination thereof, into cable form.

In order to accomplish this, please refer in particular to FIGS. 9–16 wherein a metal comb structure 90 for holding the upper and lower banks of conductors 20 in the desired relationship is shown. The comb structure 90 comprises upper and lower toothed combs 92, 94, respectively, with means for sequentially opening and closing the combs; the comb movement is controlled by a comb carriage, generally designated by the numeral 96. The comb carriage 96 and comb structure 90 will now be described.

C. Straightening and Aligning Section—Comb Carriage 96 and Comb Structure 90

Referring first, in particular, to FIG. 9, a rear carriage block 100 of comb carriage 96 is mounted for reciprocal movement, parallel to the direction of cable travel, by means of a pair of carriage rods constituting track means 97, 98, each of the carriage rods being slidably mounted for reciprocal movement within bushings 99; the bushings 99 are stably affixed to side members 25*c*, 25*b* of the twister frame 25.

Carriage block 100 carries the linkage means for (1) sequentially controlling the opening and closing of the combs 92, 94 and for (2) sequentially controlling the forward and rearward movement of the associated comb structure 90.

The upper and lower combs 92, 94 of comb structure 90 are each pivotally mounted to comb carrier members 120, 121, and are pivoted about axes transverse to the direction of cable travel, the axes being designated by the letters $A_1$ and $A_2$, respectively is FIGS. 9, 10 and 11. Comb carrier members 120, 121 are affixed to the forward end of track means 97, 98, respectively, by means of split nut and bolt means 123 or other suitable attachment means, and are thus movable with said track means 97, 98.

Each of the upper and lower combs 92, 94 have rearwardly extending arms 125, 126 provided with upper and lower converging cam surfaces 127, 128 respectively.

The frontal jaw portions 136, 137 of comb members 92, 94 are normally held together, in the position shown in FIG. 10, by means of a pair of strong coil springs 134, each of which springs 134 is mounted at the sidewalls of comb members 92, 94. The upper and lower ends of each spring 134 are affixed to each of the sidewalls of upper and lower combs 92, 94 in a conventional manner, as by attachment rivets 138. The frontal jaw portions 136, 137 are movable to the open position shown in FIG. 11 in which the coil springs 134 are placed under tension, as will be later described.

The opening and closing of the frontal jaw portions 136, 137 is accomplished in the following manner: riding on each of the cam surfaces 127, 128 of each of the upper and lower combs 92, 94 are rotatable wheels or cams 132. Cams 132 are rotatably mounted, in pairs, to cam blocks 131, 132 (see FIGS. 9–11), the cam blocks being, in turn, affixed to cam rods 140 which slidably move within bores 141, 142 of carriage tracks 97, 98. Thus, the cam blocks 130, 131 and cams 132 are constrained for movement in a direction exactly parallel to the direction of carriage movement.

Also, at the outer face of each cam block 130, 131, there is fixedly attached the forward ends of elongated cam block arms 144, 145, respectively. The rear ends of each cam block arm 144, 145 are affixed, in a conventional manner, to first and second main lever arms 106, 106*a*, respectively, at a point just below the switch abutment means 110 for switch $S_2$, as best seen in FIGS. 9, and 13–16.

The extent and timing of longitudinal movement of cam blocks 130, 131 and cam wheels 132 is thus dictated by the extent of movement, and sequencing of cam block arms 144, 145, which, in turn, is dictated by the extent of movement and sequencing of the main lever arms 106, 106*a*.

To move the jaws 136, 137 from the open position of FIG. 11 to the closed position of FIG. 10, the timed movement of lever arms 106, 106*a* (to be hereinafter described) cause cam block arms 144, 145 to be moved from the forward position shown in FIG. 11, rearwardly, to the rearward position shown in FIG. 10, i.e., in the direction of arrow C. The position shown in FIG. 10 illustrates the rearward end of the stroke of cam block arms 144, 145. The cam wheels 132 are thus moved rearwardly, along cam surfaces 127, 128, causing combs 92, 94 to be pivotally rotated about axes $A_1$, $A_2$ under the influence of coil springs 138 until jaws 136, 137 are closed, or clamped together.

To move the jaws 136, 137 from the closed position of FIG. 10 to the open position of FIG. 11, the cam block arms 144, 145 are moved forwardly, from the FIG. 10 position in the direction of arrow B (see FIG. 11), under the influence of the timed movement of lever arms 106, 106*a* (to be described hereafter), and also under the influence of return springs 143.

The return springs 143 constitute a pair of heavy coil springs, one end 143*a* of each of which is affixed to each split nut and bolt means 123, and the other end 143*b* of each of which is affixed to each of lever arms 106, 106*a*. The coil springs 143 are placed, under substantial tension. when cam block arms 144, 145 are moved to the rearward (FIG. 10) position (the closed jaw position) by means of lever arms 106, 106*a*. Later in the sequencing, when the lever arms 106, 106*a* are moved in the appropriate direction, the return springs 143 cause the cam block arms 144, 145 to be retracted in the direction of the arrow B and thereby force the jaws 136, 137 to open under the influence of the forward movement of cam wheels 132, (and to be retained in the open position overcoming the compressive force exerted by springs 134) as shown in FIG. 11.

The termination of the first lever counter $C_1$, in addition to energizing the reed switch $S_1$ to terminate twisting, also energizes a carriage solenoid, designated $SOL_1$ in the drawings, for the purpose of commencing forward carriage movement. The energization of solenoid $SOL_1$, causes the metal core or solenoid arm 102 thereof to move rearwardly (or to the right as viewed in FIG. 13). Solenoid arm 102 carries a U-shaped bracket member 104 which, in turn, carries the earlier mentioned first main linkage arm 106, the upper end of which is pivotally mounted to carriage block 100, by means of pivot rod 108. The pivot rod 108 is supported on the other side of the carriage 96 by the earlier-mentioned second main linkage arms 106*a*. As solenoid arm 102 moves rearwardly by energization of $SOL_1$, main linkage arms 106, 106*a* are pivoted, in a counter-clockwise direction as viewed in FIG. 9 about pivot rod 108 until switch $S_2$ is tripped by means of contact between switch arm 109 and intermediate switch abutment means 110.

The tripping of switch $S_2$ arm 109 closes an electrical circuit which energizes the carriage motor 112 causing the carriage assembly 96 to move forwardly along tracks 97, 98, through conventional linkage 113 (schematically shown) carrying the comb structure 90 with it.

At the same time as the carriage 96 and comb structure 90 commence their forward movement, the upper and lower combs 92, 94 are moved from the open position of FIG. 13 to the closed position of FIG. 14. This occurs because, as main linkage arms 106, 106*a* are pivotted about pivot rod 108, in a counter-clockwise direction as viewed in FIGS. 10–16, to cause the tripping of switch S2, as described earlier, cam block arms 144, 145 are moved rearwardly, along the direction of arrow C in FIG. 10, to cause cam blocks 130, 131 and cams 132 to also move rearwardly, and thereby close jaw portions 136, 137 in the manner previously described. The compressive force of coil springs 143 is overcome by the rearward movement of cam block arms 144, 145, and these springs 143 are placed under tension.

The carriage solenoid $SOL_1$, is preferably energized after a time delay through a delay relay $DR_1$, (FIG. 18) the time delay being on the order of a fraction of a second for the following reason.

As soon as $SOL_1$, is energized, the jaws 136, 137 of combs 92, 94 are closed and switch $S_2$ is tripped. It is important that the twisting phase cease and that the conductors 20 assume a side-by-side relationship before the jaws 136, 137 of the comb structure 90 closes. Thus, referring to FIG. 5, the twist phase ceases at point F and the jaws do not close until a point G downstream from point F, e.g., $\frac{1}{4}$–$\frac{3}{4}$ inch downstream where the conductors 20 have substantially zero twist and the upper and lower banks of conductors, respectively, assume a substantially planar side-by-side relationship. If the jaws 136, 137 were to clamp down on the conductors 20 before the two banks of conductors assumed non-twisted planar side-by-side relationships, the sharp teeth 152, 150 of the combs 92, 94 respectivelly, (see FIG. 12) could cut the insulation 58 of the conductors 20 or cut the conduit or core 56 of the conductors.

It is to be noted that jaws 136, 137 of the combs 92, 94 each carry a series of spaced teeth 150, 152, respectively. The V-shaped grooves 154 between the teeth 150, 152 contains each bank of conductors 20 in a precisely laterally spaced manner, which in the embodiment shown, are equidistantly spaced from each other, in the lateral direction. In the embodiment shown, the upper bank of conductors 20 are preferably contained within the grooves 154 of the upper comb 92 and the lower bank of conductors 20 contained within the grooves 155 of the lower comb 94.

The vertical spacing between jaw members 136, 137 is preferably adjustable from a zero spacing to perhaps $\frac{1}{8}$ inch or more to accommodate the processing of insulated conductors of different outside diameters without requiring differently grooved combs. To this end, a lockable adjustable stop means 156 of conventional screw-type is located near one sidewall of comb 92 and threadably adjusted to produce the desired spacing. The adjustable stop means 156 is locked in position by locking nut 158.

It will be seen from the foregoing that comb jaws 136, 137 close and forward travel of carriage assembly 96 commences almost immediately after the twisting of conductor pairs stops. The closed combs 92, 94 thus move with, and precisely laterally align, the conductors 20, in a dual planar relationship, as best seen in FIG. 12 almost immediately after twisting ceases. Because the closed combs 94, 94 move together with the moving conductors 20 the conductors are positively maintained in the just-described spatial relationship until the comb jaws 136, 137 are opened.

The extent of forward travel of comb structure 90 is limited by the extent of forward travel of carriage assembly 96. The forward travel of the carriage assembly 90 is limited primarily by the application of a carriage brake (by energization of a switch $S_3$) as will be described hereafter. The forward travel is also limited, secondarily, and in positive fashion by the abutment of the front face 101 of carriage block 100 with the rear face of bushing 99. The mechanica limitation upon the extent of travel of the carriage means can readily be decreased from a predetermined maximum length of carriage travel by any of a number of conventional means, e.g., by adding spacers between the bushing 99 and carriage block 100 (not shown) to decrease the extent of travel.

Lamination of the thus aligned straight conductors will take place at a time when the comb jaws 136, 137 are closed and in their most forward position, as best seen in FIG. 15.

Just prior to reaching the maximum forward positionof the carriage assembly 96, a switch $S_4$ is tripped to start the shifting or roll action of a conductor-aligning turrett roller 180 (which will be later described) for the purpose of bringing a roller 184 into laminating position that has aligning grooves formed therein to accept the straight portions of conductors 20. At the maximum forward position of carriage assembly 96 a switch $S_3$ is tripped to de-energize the carriage clutch 174 and engage the carriage brake 176—shown schematically in FIG,. 18. One specific means by which these actions occur will now be set forth.

A generally vertically extending plate 164 is mounted onto the track means 99 near the rear end thereof (see FIGS. 9 and 13), in particular in this regard) and thus moves along with the carriage assembly 96 which is also mounted onto the track means, as previously described. Mounted to the rear of plate 164 is a rear lever arm 160, which comprises a generally horizontally disposed bar 161 and yoke 161a, affixed to the rear of bar 161, and a generally downwardly extending bar 163 pivotally connected to the yoke 161*a* of bar 161. The forward end 162 of bar 161 is mounted to plate 164.

Connected to the lower end of the downwardly extending bar 163 of lever arm 160, are rear metal switch posts 166, 167 which act as circuit closers, as will be shortly hereinafter described. Lever arm 160 and posts 166, 167 connected thereto, are mounted for pivotal movement, about the axis of a fixed, transversely extending rod 169. The bar members 161, 163 of lever arm 160 are pivotally movable relative to each other, about the axis of a rod 170 connecting the said two bar members as shown in FIGS. 13–16.

As track means 99 moves forwardly—carrying support block or plate 164 with it, the rear lever arm 160 commences to pivot about fixed transverse pivot rod 169 thereby first rotating rear extension post 167 into contact with a switch arm 173 for a switch $S_4$ and secondly rotating rear switch post 166 into contact with a switch arm 173 for a switch $S_4$ and secondly rotating rear switch post 166 into contact with a switch arm 172 of switch $S_3$, at the time that carriage assembly 96 assumes its most forward position—as best shown in FIGS. 15, 16 and 17.

It will be noted that switch posts 166 and 167 may be made adjustable in length by threadably mounting them to the bar 163 of lever arm 160—so that the time of contact switch post 173 to switch $S_4$, and the closing of switch $S_4$ (which energizes the roll motor 190 of the turret roller 180) can then take place in precisely the proper timing sequence, i.e., just prior to the carriage 96 attaining its maximum forward position-with the laterally aligned conductors 20 carried by the combs 92, 94. Similarly, the time of contact of switch post 172 to switch $S_3$, and the closing of switch $S_3$ (which energizes the carriage brake 176) can be precisely timed with the termination of the forward movement of the carriage assembly 96.

In order to precisely laterally align both the twisted conductor pair portions 52 and the straight conductor portions 54 during the time that they are being laminated between plastic sheets or films 60, 62, a turret roller means 180 is provided at the laminating stage, which stage will now be described.

D. Laminating Section—Turret Roller Means 180

A laminating section 28 is provided just downstream of the maximum forward position of the comb jaws 136, 137 and comprises generally a turret roller means 180 and a lower laminating roller 196. Referring to FIGS. 6 and 7, the turret roller means 180 comprises a plurality of elongated transversely grooved, rollers 182, 184, each of the rollers being spaced from the other and being rotatably mounted between roller end support plates 186, 188 about an axis transverse to the movement of cable 50. Passing through the central axis of the roller end support plates 186, 188 is a roller drive shaft 189 drivingly connected to a roll motor 190, as schematically shown in FIGS. 6 and 7.

The transverse grooves 183 of the rollers 182 are machined with parallel grooves of sufficient width and depth to just contain the twisted conductor pairs and upper laminating film 60. And each of the rollers 184 is machined with narrower-width and less-deep transversely extending parallel grooves 185 to just accomodate the individual straight conductors and the upper laminating film 60.

It will be noted that three of each type of roller 182, 183 is shown in FIG. 6 but any different even member of rollers 182, 184 greater than two such as 2, 4 or 8 or more may also be suitable. It is also noted that rollers 182 (hereinafter referred to as the twist rollers) alternates with rollers 184 (hereinafter referred to as the straight rollers) in the turret roller 180, so that as the plurality of conductors 20 passes from the twist mode to the straight mode, the turret roller 180 will be rotatably shifted 60°, i.e., from the position shown in FIG. 6*a* to the position of FIG. 6*b*, wherein a straight roller 184 is placed in laminating position.

Conversely, when conductors 20 passes from the straight mode to the twist mode the turret roller 180 is programmed to rotate such that a straight roller 184 is moved from laminating position of FIG. 6*b*, to a point removed 60° therefrom, and thereby place twist roller 182 into laminating position, as shown in FIG. 6*a*.

In the drawings of FIGS. 6 and 6*a*, the turret roller 180 is shown in a position wherein twist roller 182 is in laminating position, and the apparatus of this invention is shown laminating twisted conductor pairs, that is, is laminating cable 50 in a twist mode. The next rotation of turret roller 180 will present straight roller 184 in laminating position after the twist mode has ceased and just as the straight conductor portion 54 enters the nip area of the upper roller 182 and lower laminating roller 196, being laterally aligned within closed comb jaws 136, 137 as it enters said nip area. This second position is shown in FIG. 6*b*.

The aforesaid motion of turret roller 180 is programmed in the following manner.

Switch arm 167 will be adjusted to depress, or trip, switch $S_4$, just prior to the time that carriage assembly 96 is in maximum forward position. When switch $S_4$ is tripped it energizes a circuit which closes a first roller cycle sequence delay relay DR 3 (FIG. 18) and applies power to the roll motor clutch and brake relay K5 (FIG. 18) to de-energize the brake and engage the roller motor clutch and thereby start rotation of the turret roller 180.

The relay DR 3 is used to bypass a switch $S_6$ (FIG. 18) long enough to move a cam 192 (FIGS. 7 and 18) mounted on the roller drive shaft 189, off of a switch arm for S6 (See FIGS. 6, 7 and 18) and closes the circuit. The turret roller rotation is terminated by breaking the circuit which is applying electrical power to the roller motor 190 as the straight roller 182 is precisely positioned. This may be accomplished in any one of a number of ways. For example, power can continue to be supplied to clutch and brake relay K5 at the end of the delay of relay DR 3 through a switch S6 (FIG. 18), by means of roll motor camming device 192 (FIGS. 6, 7 and 18) mounted onto the roller drive shaft 189, which closes switch $S_6$. The roll motor camming device 192 will trip switch $S_6$ to de-energize relay K5 stopping the rotation of the turret roller 180 just as the straight roller 182 overlies lower laminating roller 196, and just as straight cable commences to reach the nip area of said laminating rollers 182, 196.

A counter $C_2$ (FIG. 18) measures the length of the straight conductor portions 54 made. At the end of the $C_2$ level, the twist motor 80 is restarted, by means of a signal sent from $C_2$ which opens relay KB (FIG. 18) momentarily, de-energizing relays K1 and K2 and switch $S_1$, and thereby allowing the twist motor 80 to restart.

The trippping of $S_3$ causes the carriage clutch 174 (FIG. 18) to be disengaged and the carriage brake 176 (FIG. 18) to be energized—thereby causing the carriage assembly 96 to be held in the forward position by the carriage brake 176, until after the straight mode of the processing cycle has been completed.

Switch $S_3$ is tripped very shortly after $S_4$ is closed, as earlier noted. Thus, the straight roller 184 is placed in laminating position as the straight conductor portions 54 arrive at the laminating section 28, and a smooth transition from twist to straight modes in the cable 50 will take place.

A third level counter $C_3$ (FIG. 18) measures a small length of cable 50, which is commencing to be twisted, e.g., $\frac{3}{4}$ to $1\frac{1}{2}$ inches after the counter $C_2$ level has been completed, and comb jaws 136, 137 are opened after a predetermined amount of twist portions has been built up in the conductors 20. Thus, at the end of the count of counter $C_3$ a relay KC (FIG. 18) opens, momentarily, to de-energize relays DR 1 (FIG. 18), and DR 2 (FIG. 18) thereby releasing solenoid core 102 of carriage solenoid $SOL_1$, causing cam block lever arm 144 to move forwardly along cam surfaces 127, 128 and enabling the comb jaws 136, 137 to spread apart, as shown in FIGS. 11 and 16, before the comb jaws cut into the twisted pairs that have been formed.

Also, as cam block lever arm 144 moves forwardly, it trips the switch arm of switch $S_5$, as shown in FIG. 16, to then cause release of the brake 176 of the comb carriage 96, preferably after a time delay caused by a delay relay in the circuit. If no time delay were included, the carriage assembly 96 could move rearwardly onto the twisted conductor pairs before the jaws 136, 137 were fully open, and cut the wire 56 or insulation 58 of the conductors 20. (FIG. 18).

The carriage 96 is then retracted, along track means 97, 98 (and with comb jaws 136, 137 open) under the influence of a strong coil carriage spring 200, to a position wherein the carriage block 100 abuts the rear bushing 99. The forward end 201 of the spring 200 is fixed to the carriage block 100 and the rear end 202 of the spring is held to the rear of the fixed twister frame 25 in a conventional manner.

The comb carriage 96 is then ready for the next cycle upon its energization through switch $S_2$, as previously described.

Also, at the end of the $C_3$ counter level, the no-delay contacts of DR 1 (FIG. 18) are now closed energizing the second roll sequence delay realy DR 4 (FIG. 18). The relay DR 4 operates in the same way as roll sequence relay DR 3 to initiate roll motor action and rotate turret roller means 180, over a 60° angle, so that a twist roller 182 is positioned in overlying relationship with lower laminating roller 196, as shown in FIG. 6*a*, ready to accept and precisely laterally align twisted conductor pairs during their lamination. Roll motor action is terminated by cam 192 which trips switch $S_6$, de-energizing relay K5 and stopping the roll action.

It is important to note that the twist motor 80 is activated at the end of the C2 counter level and twisting commences prior to the opening of comb jaws 136, 137 since comb jaws are opened only at the end of the later C3 level. It will be seen that if twisting starts before the comb jaws 136, 137 are released, and are then released after a set short time, i.e., as determined by the $C_3$ counter, a transition zone of a partial twist, and of predetermined length is made, this zone being designated by the numeral 210 in FIG. 5. Now, if the $C_3$ mode is too long, too much twist is built up in zone 210 and the insulation 58 of the conductors 20 will be broken by the teeth 150, 152 of the closed combs 92, 94. Also, if the twist motor 80 is restarted after the combs 92, 94 are released and spread apart, it is difficult to control the length of straight conductors made, and too much straight conductor may be made.

The process and apparatus of this invention also includes means for heating the upper and lower plastic laminating sheets 69, 62 to their softening point, by means of hot air, blown through air nozzles 215. The air nozzles 215, through which the hot air exits, are placed closely adjacent the nip area of laminating rollers 182 or 184 and lower laminating roller 196. The critical bonding temperature for the particular plastic laminating films 60, 62 employed is well known in the art.

It will be noted, from FIG. 6, that the comb structure 90 is moved closely adjacent the exit ends of air nozzles 215, during their course of travel. In order that the comb structure 90 be kept as cool as possible and not exceed the softening temperature of the conductor insulation 58, the combs 92, 94 are provided with cooling passages 220, 222, through which suitable coolant fluid is passed in order to maintain the combs 92, 94 at the desired low temperature.

E. Post-Lamination Means

After lamination of the cable 50 under heat and pressure, the cable passes under and around cooling roller 224, over a cold roller 226, and thence proceeds to be wound onto a take-up spool (not shown) by conventional means.

The cable is pulled through the various processing stations, under a constant tension, by conventional means, and at a rate of speed that is on the order of 500–1500 feet per hour, or greater, but which may be readily varied. Imprinting of the cable 50, as it leaves the laminating rollers 182 or 184, and 196, may take place prior to cooling, if desired, by conventional means, and is designated schematically by the arrow 227.

F. Summary of Operations

Referring to FIGS. 18–20 and particularly to FIGS. 19 and 20, a summary of the sequence of operations performed by the method and apparatus of this invention will be set forth, with particular attention to the electrical interconnections.

The timing counter 230 (FIG. 18) measures the $C_1$, $C_2$ and $C_3$ levels and at the end of the $C_3$ level, all levels reduce to zero to start the next cycle.

When the A.C. power supply 232 (FIG. 18) is applied, the twist motor 80 of the apparatus of this invention is energized and twisting of conductor pairs commences until the end of counter $C_1$ level is reached. Through closure of switch $S_1$, the twist motor 80 is de-energized, and twisting ceases.

The $C_2$ counter level then commences. After a timed delay beyond cessation of the twist motor 80, the carriage solenoid $SOL_1$, is energized closing comb jaws 136, 137. Simultaneously with the closing of jaws 136, 137, carriage assembly 96 moves forward through closure of switch $S_2$. It is important that there be a slight delay between twist cessation and comb jaws closing in order to enable the two banks of conductors 20 to assume as nearly a dual planar relationship, as previously described.

The carriage assembly 96 with closed jaws moves forwardly, together with the two banks of moving conductors, and aligns the conductors 20 in a precise lateral manner as previously described, until the combs 92, 94 reach a maximum forward position.

Just prior to the attainment of the maximum forward position of the carriage assembly 96 (and comb structure 90), a shift in turret roller means 180 occurs (through $S_4$ closure) in order to shift a straight roller 184 into laminating position. This roller shift action preferably occurs just prior to the maximum forward carriage position so that the transition from twist to straight modes in the cable 50 will occur shortly just as the aligned straight portions reaches the straight roller 184.

As the carriage maximum forward position is then attained, the carriage clutch 174 is de-energized and the carriage brake 176 is energized, (through switch $S_3$ closure) and thereby retained in maximum forward position until just beyond the end of the $C_3$ level.

At the end of the $C_2$ counter level, the $C_3$ counter level commences and twist motor 80 is restarted (by de-energizing $S_1$). The carriage and comb structure 96, 90 remain in maximum forward position and comb jaws 136, 137 remain closed until the $C_3$ level ends.

At the end of $C_3$ level, the jaws 136, 137 open (through de-energization of $SOL_1$), turret roller 180 shifts to place a twist roller 182 in laminating position (through switch $S_6$) and carriage and comb structure 96, 90 retract thereafter (by closure of $S_5$ to de-energize carriage brake 176) to await the start of the next $C_2$ counter level.

The $C_3$ counter level is short for reasons earlier described and the just-described sequence enables a smooth transition from straight mode to twist mode to occur without damage. The above-stated sequence of operations is set forth in FIG. 19 as *a* through *g*.

The $C_1$ counter level (and the next cycle) commences once again after the $C_3$ counter level has been completed.

FIG. 18 illustrates the presently preferred circuitry and is shown at the point where the apparatus of this invention is initially making the twisted cable portion 52.

At the end of the first level count, relay KA closes momentarily, energizing the sequence hold relay DR 2, closing the no-delay contacts to hold itself on through KC. The delay contacts are held closed just long enough to allow the rotating magnet 82 to come around and close the reed switch $S_1$ energizing relays K1 and K2. At the end of the DR 2 delay, the delay contacts open the circuit to the reed switch $S_1$.

When relay K1, the twist motor clutch and brake hold relay, is energized, it is held on by its own contact closure through relay KB. At the same time, K2, the twist motor clutch and brake relay, is energized. This relay opens the closed circuit to the twist motor 80 and applies the brake of twist motor 80.

Meanwhile, at the time the sequence hold relay DR 2 is energized, power is also applied to the carriage solenoid delay relay DR 1. The no-delay contacts open to prevent action of the turret roller motor 190 at this moment. At the end of the delay of DR 1, the carriage solenoid $SOL_1$ is energized. This action closes the combs 92, 94 and trips $S_2$. $S_2$ applies power, through $S_3$, to the carriage clutch 174 moving the carriage assembly 96 forward. As the carriage 96 moves forward, it trips $S_3$ and $S_4$.

$S_3$ switches power from the clutch to the brake and the clutch/brake relay, K4. Relay K4 holds the carriage 96 in the full forward position. Relay K4 is held on through its own contacts by $S_5$.

$S_4$ is tripped, preferably, just prior to $S_3$. When $S_4$ is tripped, it applies power to the first roll cycle sequence delay relay DR 3. The no-delay contacts apply power to the turret roller motor clutch and brake relay, K5, to start the rolling action. The relay, DR 3 is used to bypass $S_6$ long enough to move the cam at the end of the roller shaft off of $S_6$. This action closes $S_6$. At the end of the delay of DR 3, the delay contacts open. Power to K5 is now being applied through $S_6$.

When the next cam lobe comes around, it trips $S_6$ and de-energizes K5, stopping the roll action. The machine is now making the straight cable portion 54.

At the end of the second level count, KB opens momentarily. This action de-energizes K1 and K2, and the twist motor 80 is restarted.

At the end of the third level count, relay KC opens momentarily. This action de-energizes relays DR 1 and DR 2, releasing the carriage solenoid $SOL_1$ spreading the combs 92, 94 apart. The same action trips $S_5$ releasing the carriage brake 176. The no-delay contacts on DR 1 are now closed, energizing the second roll cycle sequence delay relay DR 4. This relay then works the same way as DR 3 for the same reason.

The machine is again making the twisted cable portion 52.

G. Modifications

In an alternative and optional movement of this invention, shown in FIG. 8*a*, one or more reed switches $S_1'$ are shown, adjacent a second magnet 82*a* mounted to a twister tube 24". When reed switch $S_1'$ is energized (at the end of level counter $C_1$) it attracts and precisely aligns all twister tubes 24, 24', 24", so that the lines drawn between the axes of each conductor of a pair, are substantially horizontal and planar as they exit from the twister tubes, (as viewed from the front ends of the twister tubes). However, when reed switch $S_1'$ is energized, it causes the twister tubes 24, 24', 24" to be aligned substantially exactly 180° removed from that occurring when reed switch $S_1$, is energized to attract magnet 82.

Thus, if switch $S_1$ is first energized in a first sequence of operations to thereby commence the formation of a first straight conductor portion 54, followed by an energization of switch $S_1'$, in the next sequence of operations to thereby commence the formation of the next succeeding straight conductor portion 54, this next succeeding straight conductor portion 54 will have each conductor pair thereof aligned 180° out of phase with that of the first straight conductor portions 54.

Accordingly, in the schematic plan view of twist and straight conductor portions 52', 54', and 54", shown in FIG. 21*a*, wherein a black and brown conductor pair are shown, the upper black conductors 20" of straight conductor portion 54" becomes the lower (black) conductor 20' of straight portion 54'. This alternating arrangement of the placement of the paired conductors in successive straight conductor portions 54', 54" is of advantage in some types of mass termination techniques.

Where alternative energization between switches $S_1$ and $S_1'$ does not take place, the conductors of each pair would be arranged as shown in FIG. 21*b*, wherein the upper black conductors 20*a* in straight conductor portion 54*a* are also the upper (black) conductor 20*b* of each pair in the succeeding (or preceding) straight conductor portions 54*b*.

It will be understood that other modifications of both method and apparatus will occur to those skilled in the art, such modifications lying within the scope of this invention. Hence, I intend to be limited only be the claims which follow.

I claim:

1. A method for making multi-conductor cable having a plurality of longitudinally extending insulated conductor pairs with each of said insulated conductor pairs having twisted pair portions alternating in series, with straight portions, which comprises:

in a first cycle, twisting a plurality of individual insulated moving conductors into parallel twisted pair portions having a predetermined length of twist, terminating the twisting of each of said twisted pair portions but not the forward movement of said conductors forming said twisted pair portions, and shortly after the termination of twisting of said twisted pair portions positively maintaining each of said moving, insulated conductors forming said twisted pair portions along straight, precisely laterally spaced, paths for a predetermined distance to thereby form said straight portions of said multi-conductor cable;

successively repeating the said first cycle to form insulated conductor pairs having twisted pair portions alternating, in series, with said straight portions;

simultaneous with said first and successive cycles of operation laminating said twisted pair portions of said insulated moving conductors and said straight portions of said insulated moving conductors, between plastic sheets, while positively maintaining a first precise lateral spacing of said twisted portions during lamination, and positively maintaining a second precise lateral spacing of said straight portions alternating with said twisted portions, during lamination; and cooling the laminated cable so formed.

2. The method of claim 1 wherein said twisting of twisted pair portions is terminated, for a predetermined delay time, prior to the step of positively maintaining each of said insulated moving conductors along straight, precisely laterally spaced paths whereby a smooth transition zone from twist pair portions to straight conductor portions is achieved.

3. The method of claim 1 wherein the step of positively maintaining each of said insulated moving conductors along straight, precisely laterally spaced paths continues for a short predetermined time period, after restarting twisting in a successive cycle whereby a smooth reproducible transition zone from said straight conductor portions to said twisted pair portions occurs.

4. The method of claim 1 wherein twisting of said twisted pair portions commences a predetermined short interval of time, prior to termination of the step of positively maintaining each of said insulated moving conductors along straight precisely laterally spaced paths whereby a smooth reproducible transition zone from said straight portions to said twisted pair portions occurs.

5. The method of claim 1 wherein said twisting of individual moving insulated conductors into twisted pair portions is terminated at the point where an axial line drawn from an individual insulated moving conductor to the other individual insulated moving conductor forming a twisted pair portion lies in a substantially horizontal plane.

6. The method of claim 1 wherein said twisted pair portions are aligned in an upper bank and a lower bank immediately after twisting.

7. The method of claim 1 wherein said twisted pair portions are aligned in an upper bank and a lower bank as they enter the laminating step for lamination thereof into a multi-conductor cable.

8. The method of claim 1 wherein the direction of the twisting of each twisted pair portion is the same as in other twisted pair portions.

9. The method of claim 1 wherein the direction of the twisting of immediately adjacent twisted pairs in a twisted pair portion lie in reverse direction.

10. The method of claim 5 wherein said twisting of twisted pair portions is terminated, for a predetermined delay time, prior to the step of positively maintaining each said conductor pair along straight, precisely laterally spaced paths whereby a smooth transition zone from twisted pair portions to straight conductor portions is achieved.

11. The method of claim 6 wherein twisting of said twisted pair portions is terminated at a point where an axial line drawn through said upper bank of twisted pair portions lies within a substantially horizontal plane and an axial line drawn through said lower bank of twisted pair portions lies within a second substantially horizontal plane.

12. The method of claim 4 wherein said twisting of twisted pair portions is terminated, for a predetermined delay time, prior to the step of positively maintaining each said insulated moving conductors along straight, precisely laterally spaced paths whereby a smooth transition zone from twisted pair portions to straight conductor portions is achieved.

13. The method of claim 1 wherein a predetermined time delay occurs between the time of termination of twisting of said individual conductors and the instant of commencing the positive maintaining of each of said moving insulated conductors along straight, laterally spaced paths whereby said moving insulated conductors are positively retained in non-twisted position to thereby avoid damage to said insulated conductors.

14. The method of claim 1 wherein a predetermined time delay occurs between the time of commencement of twisting of said twisted portions and the time of termination of the period of maintainence of each said moving, insulated, conductor along straight precisely laterally spaced paths whereby to achieve a smooth transition from straight portions to twisted pair portions in said multi-conductor cable.

15. The method of claim 1 wherein said twisting of individual moving insulating conductors into twisted pair portions is terminated at a point where each twisted pair portion has its conductor axes lying in a common horizontal plane with a given conductor of each twisted pair portion lying in a first precise orientation in a first cycle of operation and said given conductor of said twisted pair portion lying in a second precise orientation which is substantially 180° removed from said first orientation after termination in a second successive cycle of operation.

* * * * *